US007309217B2

(12) United States Patent
Cho et al.

(10) Patent No.: US 7,309,217 B2
(45) **Date of Patent: *Dec. 18, 2007**

(54) VARIABLE CAPACITY ROTARY COMPRESSOR

(75) Inventors: Sung Hea Cho, Suwon-Si (KR); Seung Kap Lee, Suwon-Si (KR); Chun Mo Sung, Hwasung-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 503 days.

This patent is subject to a terminal disclaimer.

(21) Appl. No.: 10/936,641

(22) Filed: Sep. 9, 2004

(65) Prior Publication Data

US 2005/0112010 A1 May 26, 2005

(30) Foreign Application Priority Data

Nov. 25, 2003 (KR) ..... 10-2003-0084230

(51) Int. Cl.
*F04B 1/06* (2006.01)
*F04B 49/00* (2006.01)
*F01C 1/02* (2006.01)

(52) U.S. Cl. ..... 417/221; 417/212; 417/218; 418/63

(58) Field of Classification Search ..... 417/212, 417/218, 221; 418/63
See application file for complete search history.

(56) References Cited

U.S. PATENT DOCUMENTS 5,871,342 A 2/1999 Harte et al.
7,153,109 B2 * 12/2006 Cho et al. ..... 418/29
2004/0071560 A1 4/2004 Cho et al.
2005/0063849 A1 * 3/2005 Cho et al. ..... 418/23
2005/0112009 A1 * 5/2005 Lee et al. ..... 418/6
2006/0002809 A1 * 1/2006 Kawabe et al. ..... 418/63

OTHER PUBLICATIONS

U.S. Appl. No. 10/936,640, filed Sep. 9, 2004, Moon Joo Lee et al., Samsung Electronics Co, Ltd.
U.S. Appl. No. 10/922,943, filed Aug. 23, 2004, Sung Hea Cho et al., Samsung Electronics Co, Ltd.

* cited by examiner

*Primary Examiner*—Anthony D. Stashick
*Assistant Examiner*—Patrick Hamo
(74) *Attorney, Agent, or Firm*—Staas & Halsey LLP

(57) ABSTRACT

A variable capacity rotary compressor includes a hermetic casing, a housing installed in the hermetic casing to define therein first and second compression chambers having different capacities, and a compressing unit placed in the first and second compression chambers and operated to execute a compression operation in either the first or second compression chamber according to a rotating direction of a rotating shaft which drives the compressing unit. The compressor further includes a suction path controller having a hollow body and a valve unit, and a pressure controller. The hollow body has an inlet connected to a refrigerant inlet pipe, and first and second outlets formed on the hollow body at opposite ends of the hollow body to be spaced apart from the inlet of the hollow body. The valve unit is installed in the hollow body to axially reciprocate in the hollow body to change a refrigerant suction path by a pressure difference between the first and second outlets of the hollow body. The pressure controller includes a high-pressure pipe to connect an outlet side of the compressor to the suction path controller, and first and second communicating paths provided on both sides of the valve unit to be spaced apart from each other.

19 Claims, 8 Drawing Sheets

VARIABLE CAPACITY ROTARY COMPRESSOR

CROSS-REFERENCE TO RELATED APPLICATIONS

This application claims the benefit of Korean Patent Application No. 2003-84230, filed Nov. 25, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which has a pressure controller to allow an internal pressure of a compression chamber where an idle operation is executed, to be equal to an internal pressure of a hermetic casing.

2. Description of the Related Art

Recently, a variable capacity compressor has been increasingly used in refrigeration systems, such as air conditioners or refrigerators, to vary the cooling capacity as desired, to accomplish an optimum cooling operation and saving energy.

In Korea Patent Application No. 2002-61462 there is disclosed a variable capacity rotary compressor which was filed by the inventor of the present invention. In the Korea Patent Application No. 2002-61462, the compressor is designed to execute a compression operation in either of two compression chambers having different capacities.

The variable capacity rotary compressor includes two compression chambers and two eccentric units. The two eccentric units are respectively installed in each of the compression chambers, and are operated so that one of two rollers respectively placed in each of the compression chambers, is eccentric from a rotating shaft to execute a compression operation while a remaining one of the rollers is released from eccentricity from the rotating shaft to prevent the compression operation from being executed, according to a rotating direction of the rotating shaft. Each of the eccentric units includes an eccentric cam and an eccentric bush. The eccentric cams of the eccentric units are respectively provided on an outer surface of the rotating shaft to be placed in each of the compression chambers. The eccentric bushes are rotatably fitted over the eccentric cams, respectively. Further, the rollers are respectively fitted over each of the eccentric bushes. A locking pin causes one of the eccentric bushes to be eccentric from the rotating shaft while causing a remaining one of the eccentric bushes to be released from eccentricity from the rotating shaft, when the rotating shaft rotates. Two vanes are respectively installed in each of the compression chambers to reciprocate in a radial direction. The compression chambers are respectively partitioned into an intake space and a discharging space by each of the vanes.

The variable capacity rotary compressor is constructed such that the compression operation is executed in one of the two compression chambers having different capacities while the idle operation is executed in a remaining one of the compression chambers, by the eccentric units. Thus, the compression capacity of the compressor is varied by only changing the rotating direction of the rotating shaft.

SUMMARY OF THE INVENTION

Accordingly, an aspect of the present invention provides a variable capacity rotary compressor which has a pressure controller to allow an internal pressure of a compression chamber where an idle operation is executed, to be equal to a pressure of an outlet side of the compressor, to prevent a vane from pressing an outer surface of a roller and to prevent oil from flowing into the compression chamber, therefore minimizing a rotating resistance.

A further aspect of the invention provides a conventional variable capacity rotary compressor in which an internal pressure of a compression chamber where the idle operation is executed, is not lower than an internal pressure of the hermetic casing, which is a pressure of an outlet side of the compressor, to prevent a vane from rotating while pressing an outer surface of a roller which executes an idle rotation, and to prevent oil from flowing into a compression chamber where the idle operation is executed, therefore preventing a rotating resistance.

The above and/or other aspects are achieved by a variable capacity rotary compressor including a hermetic casing, a housing installed in the hermetic casing to define therein first and second compression chambers having different capacities, and a compressing unit placed in the first and second compression chambers and operated to execute a compression operation in either the first or second compression chamber according to a rotating direction of a rotating shaft which drives the compressing unit. The variable capacity rotary compressor further includes a suction path controller, and a pressure controller. In this case, the suction path controller includes a hollow body and a valve unit. The hollow body includes an inlet connected to a refrigerant inlet pipe, and first and second outlets formed on the hollow body at opposite ends of the hollow body to be spaced apart from the inlet of the hollow body. The first and second outlets are respectively connected to corresponding inlet ports of the first and second compression chambers. The valve unit is installed in the hollow body to axially reciprocate in the hollow body, to change a refrigerant suction path by a pressure difference between the first and second outlets of the hollow body. The pressure controller includes a high-pressure pipe to connect an outlet side of the compressor to the suction path controller, and first and second communicating paths provided on both sides of the valve unit to be spaced apart from each other. Either the first or second communicating path communicates with an outlet of the high-pressure pipe in response to an operation of the valve unit so that a pressure of the high-pressure pipe acts on the first or second compression chamber where an idle operation is executed.

According to another aspect of the invention, the valve unit may include a valve seat provided in the hollow body to communicate with the inlet of the hollow body of the suction path controller, and first and second valves provided at both sides in the hollow body to open either of opposite ends of the valve seat. The first and second valves may be connected to each other by a rod.

In another aspect of the invention, the variable capacity rotary compressor may further include a rod supporter provided in the valve seat to support the rod so that the rod passes through the valve seat. In this case, a path may be provided on a predetermined portion of the rod supporter to connect the high-pressure pipe to a through hole which the rod passes through.

In yet another aspect of the invention, the first communicating path may extend from a first position of the rod to correspond to an outlet of the high-pressure pipe to communicate with a first end of the rod which is adjacent to the second outlet of the hollow body, so that the high-pressure pipe communicates with the second outlet of the hollow body, when the first and second valves move toward the first outlet of the hollow body so that a refrigerant is delivered into the first outlet of the hollow body. Further, the second communicating path may extend from a second position of the rod to correspond to the outlet of the high-pressure pipe to communicate with a second end of the rod which is adjacent to the first outlet of the hollow body, so that the high-pressure pipe communicates with the first outlet of the hollow body, when the first and second valves move toward the second outlet of the hollow body so that the refrigerant is delivered into the second outlet of the hollow body.

In still another aspect of the invention, the variable capacity rotary compressor may further include communicating grooves respectively provided around each of the first and second positions of the rod to connect the outlet of the high-pressure pipe to the first or second communicating path even when the rod rotates.

In yet another aspect of the invention, the variable capacity rotary compressor may further include sealing members provided on both ends of the through hole which is formed on a predetermined portion of the rod supporter to prevent air from leaking through a gap between the through hole and the rod.

In still another aspect of the invention, each of the first and second valves may include a thin valve plate to come into contact with the valve seat, and a supporter to support the thin valve plate.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
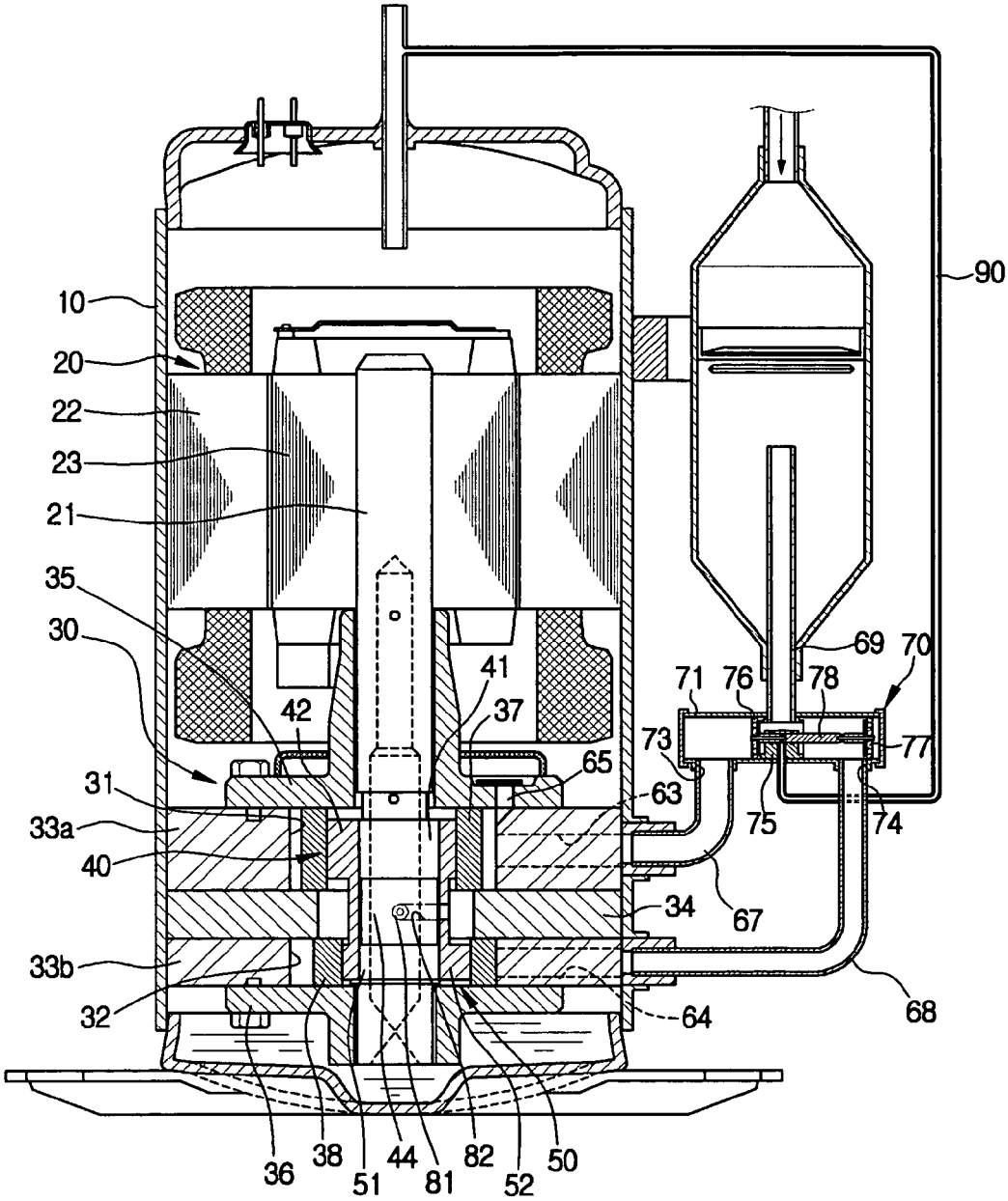
FIG. 1 is a sectional view of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a variable capacity rotary compressor according to the present invention includes a hermetic casing 10, with a driver 20 and a compressing unit 30 being installed in the hermetic casing 10. The driver 20 is installed on an upper portion of the hermetic casing 10 to generate a rotating force. The compressing unit 30 is installed on a lower portion of the hermetic casing 10 to be connected to the driver 20 through a rotating shaft 21. The driver 20 includes a cylindrical stator 22 and a rotor 23. The stator 22 is mounted to an inner surface of the casing 10. The rotor 23 is rotatably and concentrically set in the stator 22, and is mounted to the rotating shaft 21. The driver 20 rotates the rotating shaft 21 in opposite directions.

The compressing unit 30 includes a housing. Cylindrical first and second compression chambers 31 and 32, having different capacities, are provided on upper and lower portions of the housing, respectively. The housing includes a first housing 33*a* to define the first compression chamber 31 therein, and a second housing 33*b* to define the second compression chamber 32 therein. The housing also has upper and lower flanges 35 and 36 to rotatably support the rotating shaft 21. The upper flange 35 is mounted to an upper surface of the first housing 33*a* to close an upper portion of the first compression chamber 31, and the lower flange 36 is mounted to a lower surface of the second housing 33*b* to close a lower portion of the second compression chamber 32. A partition 34 is interposed between the first and second housings 33*a* and 33*b* so that the first and second compression chambers 31 and 32 are partitioned from each other.

As shown in FIGS. 1 to 4, the rotating shaft 21, installed in the first and second compression chambers 31 and 32, is provided with first and second eccentric units 40 and 50 which are arranged on upper and lower portions of the rotating shaft 21, respectively. First and second rollers 37 and 38 are rotatably fitted over the first and second eccentric units 40 and 50, respectively. A first vane 61 is installed between an inlet 63 and an outlet 65 of the first compression chamber 31, and reciprocates in a radial direction while being in contact with an outer surface of the first roller 37, to execute a compression operation. Further, a second vane 62 is installed between an inlet 64 and an outlet 66 of the second compression chamber 32, and reciprocates in the radial direction while being in contact with an outer surface of the second roller 38, to execute the compression operation. The first and second vanes 61 and 62 are biased by first and second vane springs 61*a* and 62*a*, respectively. Further, the inlet and outlets 63 and 65 of the first compression chamber 31 are arranged on opposite sides of the first vane 61. Similarly, the inlet and outlets 64 and 66 of the second compression chamber 32 are arranged on opposite sides of the second vane 62. Although not shown in the drawings in detail, the outlets 65 and 66 communicate with an interior of the hermetic casing 10 via a path defined in the housing.

Figure 2:
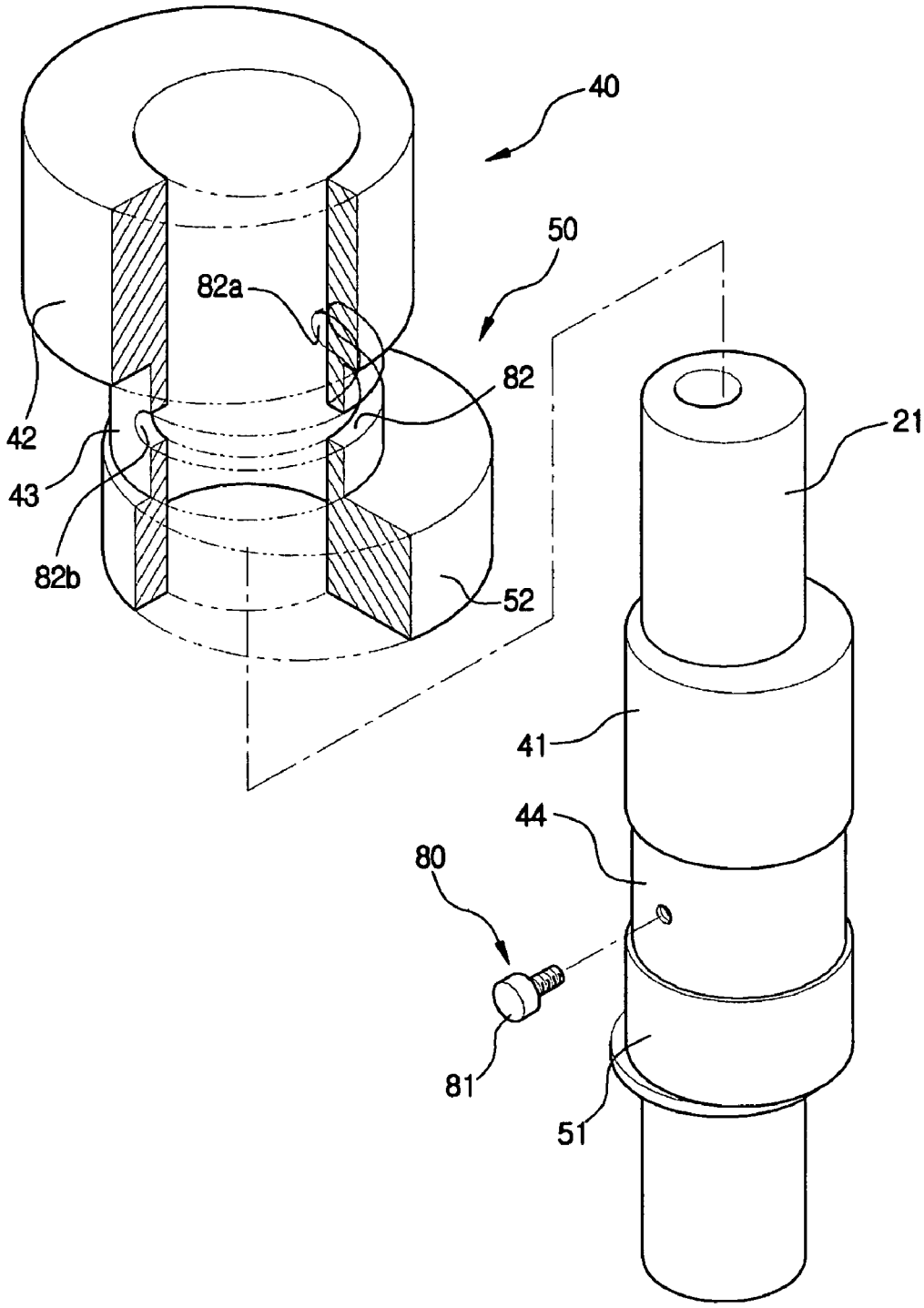
FIG. 2 is a perspective view of eccentric units included in the variable capacity rotary compressor of FIG. 1.

The first and second eccentric units 40 and 50 include first and second eccentric cams 41 and 51, respectively. The first and second eccentric cams 41 and 51 are provided on an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As shown in FIG. 2, the first and second eccentric bushes 42 and 52 are integrally connected to each other by a cylindrical connecter 43, and are eccentric from the rotating shaft 21 in opposite directions. Further, the first and second rollers 37 and 38 are rotatably fitted over the first and second eccentric bushes 42 and 52, respectively.

Figure 3:
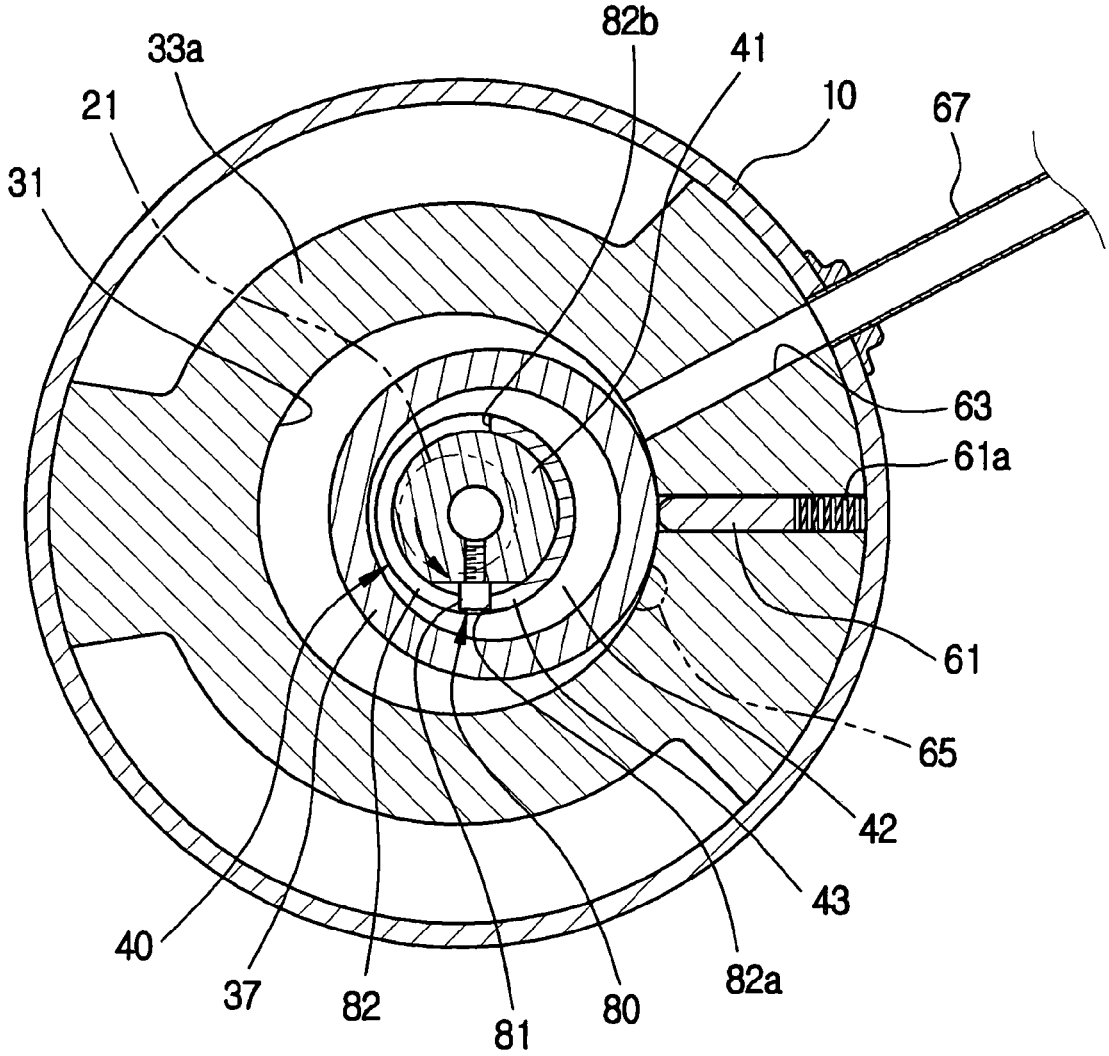
FIG. 3 is a sectional view to show a compression operation of a first compression chamber, when a rotating shaft of the variable capacity rotary compressor of FIG. 1 rotates in a first direction.

As shown in FIGS. 2 and 3, an eccentric part 44 is provided on the outer surface of the rotating shaft 21 between the first and second eccentric cams 41 and 51 to be eccentric from the rotating shaft 21 in the same direction as the first and second eccentric cams 41 and 51. A lock 80 is mounted to the eccentric part 44. In this case, the lock 80 causes one of the first and second eccentric bushes 42 and 52 to be eccentric from the rotating shaft 21 while releasing a remaining one of the first and second eccentric bushes 42 and 52 from eccentricity from the rotating shaft 21, according to a rotating direction of the rotating shaft 21. The lock 80 includes a locking pin 81 and a locking slot 82. The locking pin 81 is mounted to a surface of the eccentric part 44 in a screw-type fastening method to be projected from the surface of the eccentric part 44. The locking slot 82 is formed around a part of the connecter 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from the eccentricity from the rotating shaft 21, according to the rotating direction of the rotating shaft 21.

When the rotating shaft 21 rotates while the locking pin 81, which is mounted to the eccentric part 44 of the rotating shaft 21, engages with the locking slot 82 of the connecter 43, the locking pin 81 rotates within the locking slot 82 to be locked by either of first and second locking parts 82*a* and 82*b* which are formed at opposite ends of the locking slot 82, to cause the first and second eccentric bushes 42 and 52 to rotate along with the rotating shaft 21. Further, when the locking pin 81 is locked by either of the first and second locking parts 82*a* and 82*b* of the locking slot 82, one of the first and second eccentric bushes 42 and 52 is eccentric from the rotating shaft 21 and a remaining one of the first and second eccentric bushes 42 and 52 is released from the eccentricity from the rotating shaft 21, to execute the compression operation in one of the first and second compression chambers 31 and 32 and to execute an idle operation in a remaining one of the first and second eccentric compression chambers 31 and 32. On the other hand, when the rotating direction of the rotating shaft 21 is changed, the first and second eccentric bushes 42 and 52 are arranged oppositely to the above-mentioned state.

As shown in FIG. 1, the variable capacity rotary compressor according to the present invention also includes a suction path controller 70. The suction path controller 70 controls a refrigerant suction path so that a refrigerant fed from a refrigerant inlet pipe 69 is delivered into either the inlet 63 of the first compression chamber 31 or the inlet 64 of the second compression chamber 32. Therefore, the refrigerant is delivered into the inlet port of the compression chamber where the compression operation is executed.

Figure 7:
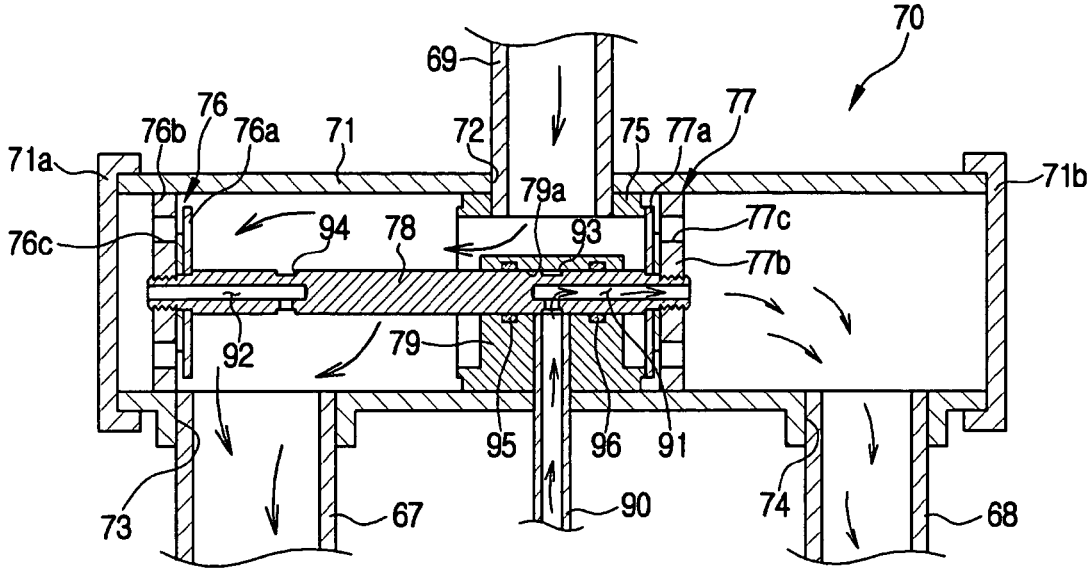
FIG. 7 is a sectional view to show an operation of a suction path controller and a first mode of a high-pressure path, when the compression operation is executed in the first compression chamber of the variable capacity rotary compressor of FIG. 1.
Figure 8:
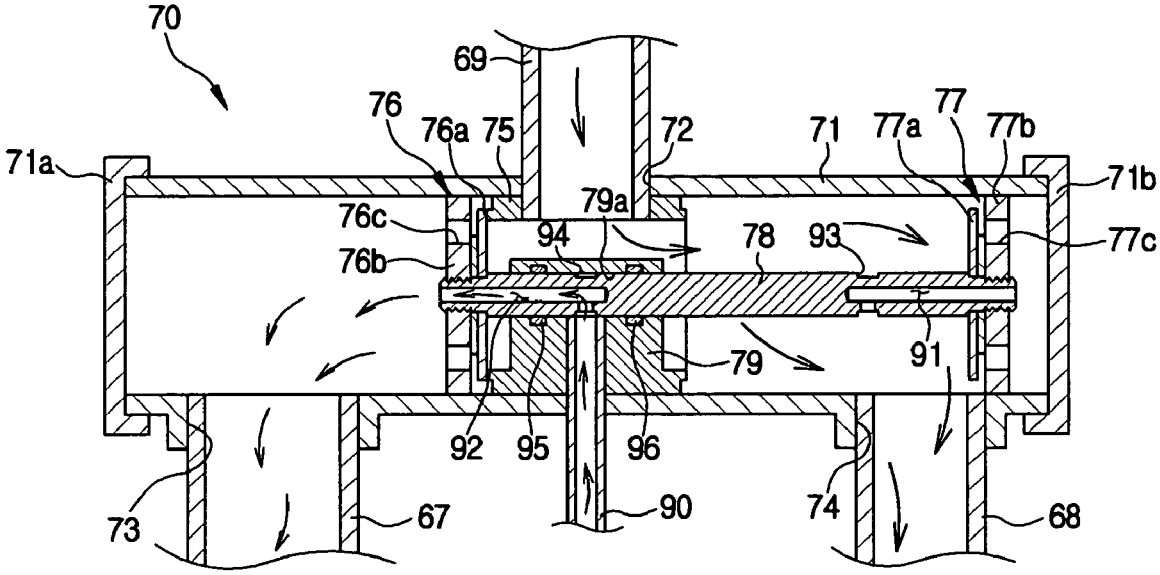
FIG. 8 is a sectional view to show the operation of the suction path controller and a second mode of the high-pressure path, when the compression operation is executed in the second compression chamber of the variable capacity rotary compressor of FIG. 1.

As shown in FIGS. 7 and 8, the suction path controller 70 includes a hollow body 71. The body 71 has a cylindrical shape of a predetermined length, and is closed at opposite ends thereof by first and second plugs 71*a* and 71*b*. An inlet 72 is formed at a central portion of the body 71 to be connected to the refrigerant inlet pipe 69. First and second outlets 73 and 74 are formed on the body 71 at opposite ends of the inlet 72 to be spaced apart from each other. Two pipes 67 and 68, which are connected to the inlet 63 of the first compression chamber 31 and the inlet 64 of the second compression chamber 32, respectively, are connected to the first and second outlets 73 and 74, respectively.

Further, the suction path controller 70 includes a valve unit. The valve unit is installed in the body 71 to control the refrigerant suction path by a pressure difference between the first and second outlets 73 and 74. In this case, the valve unit includes a valve seat 75, first and second valves 76 and 77, and a rod 78. The valve seat 75 is provided in the body 71 to form a step on an internal surface of the body 71, and has a cylindrical shape which is opened at opposite ends thereof. The first and second valves 76 and 77 are provided at both sides in the body 71, and axially reciprocate in the body 71 to open one of the opposite ends of the valve seat 75. Further, the rod 78 connects the first and second valves 76 and 77 to each other so that the first and second valves 76 and 77 move together.

The valve seat 75 has an opening at a center thereof to communicate with the inlet 72. An outer surface of the valve seat 75 is press-fitted into an inner surface of the body 71. Further, a rod supporter 79 is provided in the valve seat 75 to support the rod 78 in such a way that the rod 78 passes through the valve seat 75. The first and second valves 76 and 77 are respectively mounted to opposite ends of the rod 78. The first valve 76 includes a thin valve plate 76*a* and a supporter 76*b*, and the second valve 77 includes a thin valve plate 77*a* and a supporter 77*b*. Each of the valve plates 76*a* and 77*a* contacts with the valve seat 75 to close the refrigerant suction path. The supporters 76*b* and 77*b* are mounted to the opposite ends of the rod 78 to support the valve plates 76*a* and 77*a* in the body 71. In this case, each of the supporters 76*b* and 77*b* has an outer diameter to correspond to an inner diameter of the body 71 so as to smoothly reciprocate in the body 71. A plurality of holes 76*c* and 77*c* are formed on the supporters 76*b* and 77*b*, respectively, to allow air ventilation.

Further, the variable capacity rotary compressor according to the present invention includes a pressure controller. The pressure controller makes an outlet pressure of the compressor be applied to the compression chamber 31, 32 where the idle operation is executed, to allow the internal pressure of the compression chamber 31, 32 where the idle operation is executed, to be equal to the internal pressure of the hermetic casing 10.

As shown in FIGS. 1 and 7, the pressure controller includes a high-pressure pipe 90, and first and second communicating paths 91 and 92. The high-pressure pipe 90 connects the outlet side of the compressor to the suction path controller 70. The first and second communicating paths 91 and 92 are respectively provided on both sides of the rod 78 of the suction path controller 70 so that the high-pressure pipe 90 communicates with the inlet 63, 64 of the first, second compression chamber 31, 32 where the idle operation is executed, when the refrigerant suction path is controlled by the suction path controller 70.

As shown in FIG. 7, the high-pressure pipe 90 is connected to a predetermined portion of the rod supporter 79 of the valve seat 75. A path is provided on the rod supporter 79 so that an outlet of the high-pressure pipe 90 communicates with a through hole 79*a* which the rod 78 passes through. Further, the first communicating path 91 extends from a first position of the rod 78 to correspond to an outlet of the high-pressure pipe 90, to a first end of the rod 78 which is adjacent to the second outlet 74 of the body 71, so that the outlet of the high-pressure pipe 90 communicates with the second outlet 74, when the first and second valves 76 and 77 move toward the first outlet 73 of the body 71 so that the refrigerant is delivered into the first outlet 73. As shown in FIG. 8, the second communicating path 92 extends from a second position of the rod 78 to correspond to the outlet of the high-pressure pipe 90, to a second end of the rod 78 which is adjacent to the first outlet 73 of the body 71, so that the outlet of the high-pressure pipe 90 communicates with the first outlet 73, when the first and second valves 76 and 77 move toward the second outlet 74 of the body 71 so that the refrigerant is delivered into the second outlet 73.

Further, communicating grooves 93 and 94 are respectively provided around the first and second positions of the rod 78 to correspond to inlets of the first and second communicating paths 91 and 92, so that the outlet of the high-pressure pipe 90 is connected to the first or second communicating path 91 or 92, although the rod 78 rotates while axially reciprocating in the body 71. Further, sealing members 95 and 96 are provided on both ends of the through hole 79*a* of the rod supporter 79 which the rod 78 passes through, to prevent air from leaking through a gap between the through hole 79*a* and the rod 78.

The operation of the variable capacity rotary compressor will be described in the following.

Figure 4:
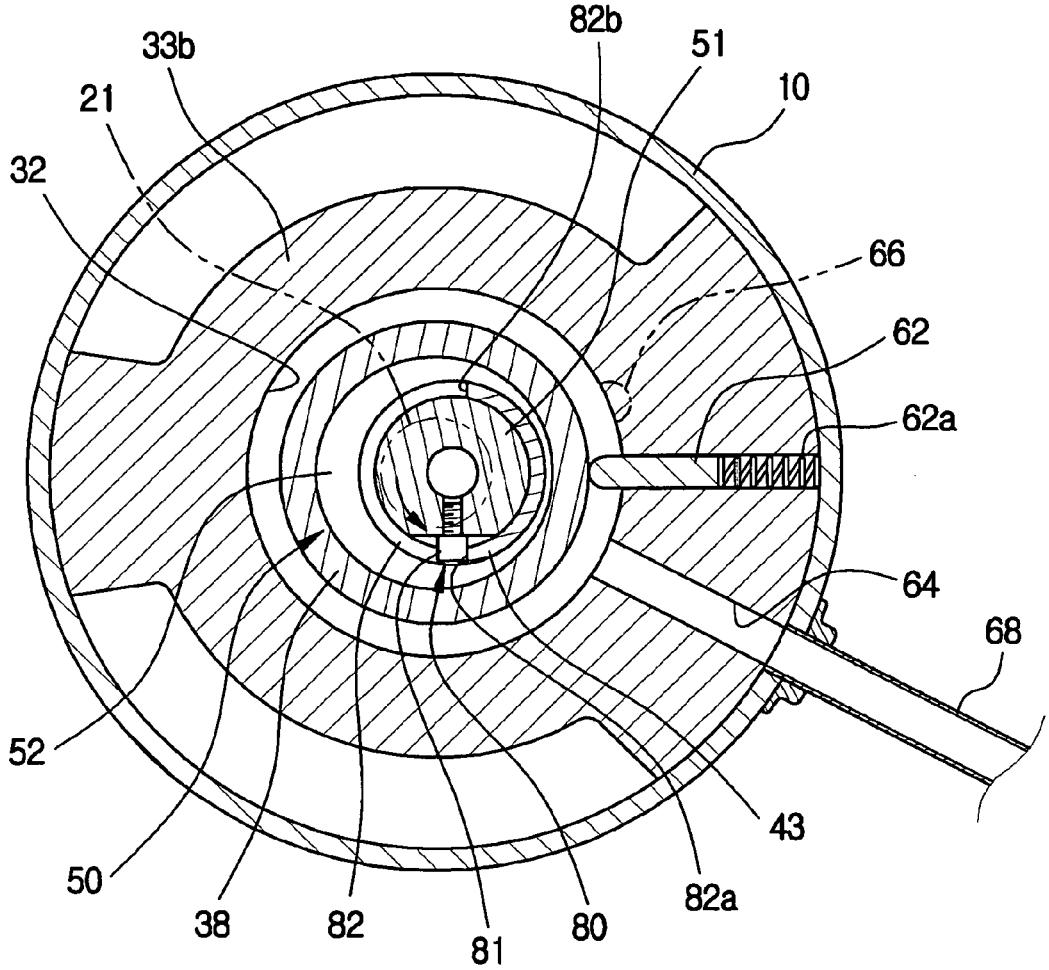
FIG. 4 is a sectional view to show an idle operation of a second compression chamber, when the rotating shaft of the variable capacity rotary compressor of FIG. 1 rotates in the first direction.

As shown in FIG. 3, when the rotating shaft 21 rotates in a first direction, an outer surface of the first eccentric bush 42 in the first compression chamber 31 is eccentric from the rotating shaft 21 and the locking pin 81 is locked by the first locking part 82*a* of the locking slot 82. Thus, the first roller 37 rotates while coming into contact with an inner surface of the first compression chamber 31 to execute the compression operation in the first compression chamber 31. Meanwhile, in the second compression chamber 32 where the second eccentric bush 52 is placed, an outer surface of the second eccentric bush 52, which is eccentric in a direction opposite to the first eccentric bush 42, is concentric with the rotating shaft 21, and the second roller 38 is spaced apart from an inner surface of the second compression chamber 32, as shown in FIG. 4. Thus the idle operation is executed in the second compression chamber 32.

When the compression operation is executed in the first compression chamber 31, the refrigerant is delivered into the inlet 63 of the first compression chamber 31. Thus, the suction path controller 70 controls the path so that the refrigerant is delivered into only the first compression chamber 31. In this case, as shown in FIG. 7, the first and second valves 76 and 77 move toward the first outlet 73 of the body 71 as a result of a suction force which acts on the first outlet 73, to form the refrigerant suction path so that the refrigerant is delivered into the first outlet 73. Meanwhile, because the valve plate 77*a* of the second valve 77 closes an end of the valve seat 75 which communicates with the second outlet 74 of the body 71, the refrigerant is not delivered into the second outlet 74.

At this time, the outlet of the high-pressure pipe 90 connected to the suction path controller 70 communicates with the second outlet 74 of the body 71 through the first communicating path 91 which is provided on the rod 78, so that the pressure of the outlet side of the compressor acts on the second compression chamber 32 where the idle operation is executed. Thus, an internal pressure of the second compression chamber 32 where the idle operation is executed, is equal to an internal pressure of the hermetic casing 10 which is a pressure of the outlet side of the compressor to prevent the second vane 62 from pressing the outer surface of the second roller 38 which executes an idle rotation, and to prevent oil from flowing into the second compression chamber 32, and to allow the rotating shaft 21 to smoothly rotate.

Figure 5:
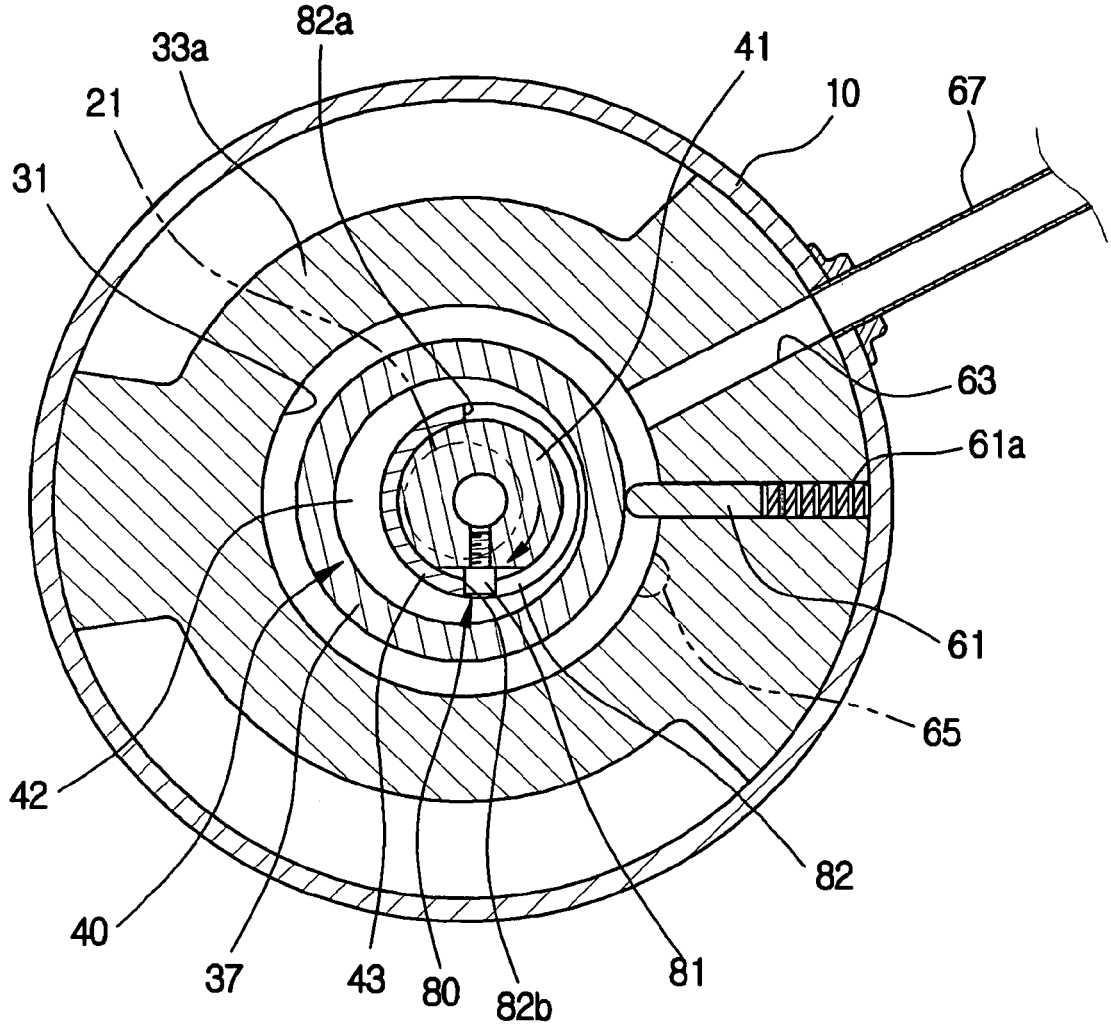
FIG. 5 is a sectional view to show an idle operation of the first compression chamber, when the rotating shaft of the variable capacity rotary compressor of FIG. 1 rotates in a second direction.
Figure 6:
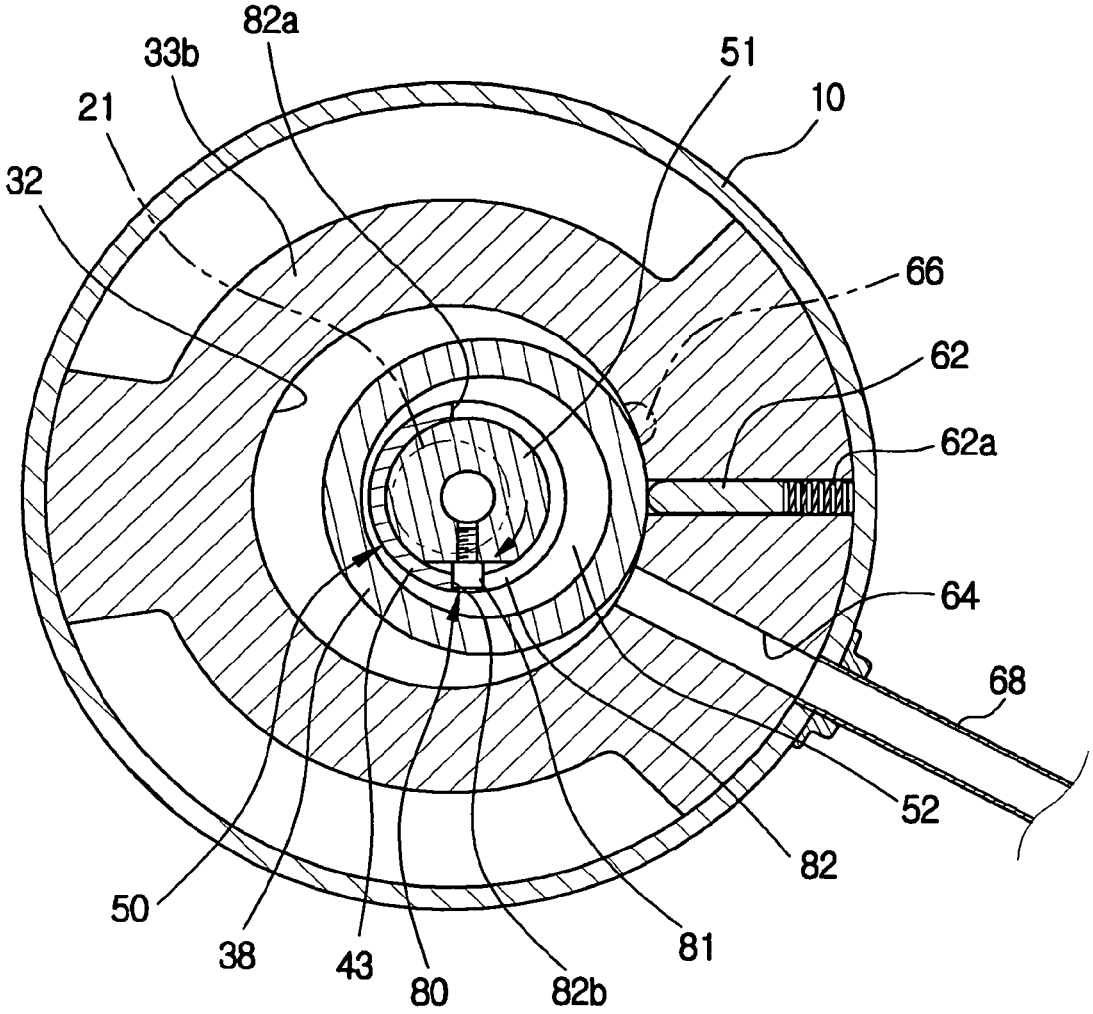
FIG. 6 is a sectional view to show a compression operation of the second compression chamber, when the rotating shaft of the variable capacity rotary compressor of FIG. 1 rotates in the second direction.

Meanwhile, as shown in FIG. 5, when the rotating shaft 21 rotates in a second direction, the outer surface of the first eccentric bush 42 in the first compression chamber 31 is released from the eccentricity from the rotating shaft 21 and the locking pin 81 is locked by the second locking part 82*b* of the locking slot 82. Thus, the first roller 37 rotates while being spaced apart from the inner surface of the first compression chamber 31, so that the idle operation is executed in the first compression chamber 31. Meanwhile, in the second compression chamber 32 where the second eccentric bush 52 is placed, the outer surface of the second eccentric bush 52 is eccentric from the rotating shaft 21, and the second roller 38 rotates while being in contact with the inner surface of the second compression chamber 32, as shown in FIG. 6. Thus the compression operation is executed in the second compression chamber 32.

When the compression operation is executed in the second compression chamber 32, the refrigerant is delivered into the inlet port 64 of the second compression chamber 32. The path controller 70 is operated to control the path so that the refrigerant is delivered into only the second compression chamber 32. In this case, as shown in FIG. 8, the first and second valves 76 and 77 move toward the second outlet 74 of the body 71 by a suction force which acts on the second outlet 74 to form the refrigerant suction path so that the refrigerant is delivered into the second outlet 74.

At this time, the outlet of the high-pressure pipe 90 connected to the suction path controller 70 communicates with the first outlet 73 of the body 71 through the second communicating path 92 which is provided on the rod 78, so that the pressure of the outlet side of the compressor acts on the first compression chamber 31 where the idle operation is executed. Thus, an internal pressure of the first compression chamber 31 where the idle operation is executed, is equal to the internal pressure of the hermetic casing 10 which is the pressure of the outlet side of the compressor to prevent the first vane 61 from pressing the outer surface of the first roller 37 which executes the idle rotation, and preventing oil from flowing into the first compression chamber 31, and to allow the rotating shaft 21 to smoothly rotate.

As is apparent from the above description, the present invention provides a variable capacity rotary compressor which is constructed so that a refrigerant suction path is controlled by a suction path controller, and a high-pressure path is controlled to cause a high-pressure pipe to communicate with a compression chamber where an idle operation is executed, so that a pressure of an outlet side of the compressor acts on the compression chamber where the idle operation is executed. Thus, there is no pressure difference between an interior of a hermetic casing and an interior of the compression chamber where the idle operation is executed to prevent a vane in the compression chamber where the idle operation is executed from pressing an outer surface of a roller in the compression chamber, therefore minimizing a rotating resistance action on the roller, and to allow the compressor to be efficiently operated.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, including a hermetic casing, a housing installed in the hermetic casing to define therein first and second compression chambers having different capacities, and a compressing unit placed in the first and second compression chambers, to execute a compression operation in either the first or second compression chamber according to a rotating direction of a rotating shaft which drives the compressing unit, the variable capacity rotary compressor comprising:

a suction path controller, including a hollow body, having an inlet connected to a refrigerant inlet pipe, and first and second outlets formed on the hollow body at opposite ends of the hollow body to be spaced apart from the inlet of the hollow body, the first and second outlets being respectively connected to corresponding inlet ports of the first and second compression chambers, and a valve unit installed in the hollow body to axially reciprocate in the hollow body to change a refrigerant suction path by a pressure difference between the first and second outlets of the hollow body; and a pressure controller, including a high-pressure pipe to connect an outlet side of the compressor to the suction path controller, and first and second communicating paths provided on both sides of the valve unit to be spaced apart from each other, either the first or second communicating path communicating with an outlet of the high-pressure pipe in response to an operation of the valve unit so that a pressure of the high-pressure pipe acts on the first or second compression chamber where an idle operation is executed.

2. The variable capacity rotary compressor according to claim 1, wherein the valve unit comprises:

a valve seat provided in the hollow body to communicate with the inlet of the hollow body of the suction path controller; and first and second valves respectively provided at both sides in the hollow body to open either of opposite ends of the valve seat, the first and second valves being connected to each other by a rod.

3. The variable capacity rotary compressor according to claim 2, further comprising:

a rod supporter provided in the valve seat to support the rod so that the rod passes through the valve seat, with a path being provided on a predetermined portion of the rod supporter to connect the high-pressure pipe to a through hole which the rod passes through.

4. The variable capacity rotary compressor according to claim 3, wherein the first communicating path extends from a first position of the rod to correspond to an outlet of the high-pressure pipe to communicate with a first end of the rod which is adjacent to the second outlet of the hollow body, so that the high-pressure pipe communicates with the second outlet of the hollow body, when the first and second valves move toward the first outlet of the hollow body so that a refrigerant is delivered into the first outlet of the hollow body.

5. The variable capacity rotary compressor according to claim 4, wherein the second communicating path extends from a second position of the rod to correspond to the outlet of the high-pressure pipe to communicate with a second end of the rod which is adjacent to the first outlet of the hollow body, so that the high-pressure pipe communicates with the first outlet of the hollow body, when the first and second valves move toward the second outlet of the hollow body so that the refrigerant is delivered into the second outlet of the hollow body.

6. The variable capacity rotary compressor according to claim 5, further comprising communicating grooves respectively provided around each of the first and second positions of the rod to connect the outlet of the high-pressure pipe to the first or second communicating path even when the rod rotates.

7. The variable capacity rotary compressor according to claim 3, further comprising sealing members provided on both ends of the through hole which is formed on a predetermined portion of the rod supporter to prevent air from leaking through a gap between the through hole and the rod.

8. The variable capacity rotary compressor according to claim 2, wherein each of the first and second valves comprises:

a thin valve plate to contact with the valve seat; and a supporter to support the thin valve plate.

9. A compressor, including first and second compression chambers, having inlets and outlets on an inlet and an outlet side, respectively, to execute compression and idle operations, to allow an internal pressure of the compression chambers, when executing the idle operation, to be equal to a pressure of the outlet side of the compressor, comprising:

a suction path controller, including a hollow body having outlets and a refrigerant suction path, to deliver a refrigerant to the inlet of the compression chamber where the compression operation is executed;

a valve unit installed in the hollow body to change the refrigerant suction path by a pressure difference between the first and second outlets of the hollow body; and a pressure controller, including a high-pressure pipe to connect an outlet side of the compressor to the suction path controller, and first and second communicating paths respectively provided on both sides of the valve to be spaced apart from each other, either the first or second communicating path communicating with an outlet of the high-pressure pipe in response to an operation of the valve so that a pressure of the high-pressure pipe acts on the first or second compression chamber where an idle operation is executed.

10. The compressor according to claim 9, wherein the suction path controller comprises:

a cylindrical hollow body having open opposite ends; and first and second plugs to close the open opposite ends of the hollow body.

11. The compressor according to claim 9, wherein the suction path controller comprises an inlet at a control portion of the hollow body to supply refrigerant to the controller.

12. The compressor according to claim 11, wherein the suction path controller further comprises:

first and second outlets, which are separated from one another, on the body and opposite to the inlet; and pipes, connected to the inlets of the compression chambers, are connected to the first and second outlets of the suction path controller, respectively.

13. The compressor according to claim 12, wherein the suction path controller comprises:

a cylindrical valve seat, which is opened at opposite ends thereof, to be provided in the hollow body;

first and second valves to reciprocate into and out of the open opposite ends of the body, respectively, to open and close the open opposite ends of the cylindrical valve seat to change the refrigerant suction path; and a rod to integrally connect the first and second valves.

14. The compressor according to claim 13, wherein the cylindrical valve seat comprises:

an opening at a center thereof to communicate with the inlet;

a rod supporter having a through hole, through which the rod extends, to support the rod; and an outer surface which is press fit into the hollow body.

15. The compressor according to claim 9, further comprising a hermetic casing around the compressor, wherein the pressure controller causes an outlet pressure of the compressor to be applied to the compression chamber where the idle operation is executed to allow the internal pressure of the compression chamber to be equal to the internal pressure of the hermetic casing.

16. The compressor according to claim 13, wherein the high pressure pipe comprises:

a high pressure pipe to connect the outlet side of the compressor with the suction path controller; and first and second communicating paths, provided on sides of the rod, to allow the high pressure pipe to communicate with the inlets of the compression chambers.

17. The compressor according to claim 16, further comprising first and second communicating paths, having an initial end, in the rod supporter, wherein:

the high pressure pipe is connected to a predetermined portion of the rod supporter, and the high pressure pipe comprises an outlet which is allowed to communicate with the through hole of the rod supporter via the initial end of the communicating path.

18. The compressor according to claim 17, wherein:

the first communicating path extends from a first position of the rod, in which the rod is adjacent to the second outlet of the body such that the outlet of the high pressure pipe communicates with the second outlet, so that refrigerant is delivered to the first outlet, and the second communicating path extends from a second position of the rod, in which the rod is adjacent to the first outlet of the body such that the outlet of the high pressure pipe communicates with the first outlet, so that refrigerant is delivered to the second outlet.

19. The compressor according to claim 18, further comprising:

communicating grooves respectively provided around the first and second positions of the rod to correspond to inlets of the first and second communicating paths so that the outlet of the high pressure pipe is connected to the first or second communicating paths; and sealing members respectively on both ends of the through hole of the rod supporter which the rod extends through to prevent air from leaking through a gap between the through hole and the rod.

* * * * *